US005970834A

United States Patent [19]

Garofano et al.

[11] Patent Number: 5,970,834

[45] Date of Patent: Oct. 26, 1999

[54] DEPALLETIZER AND HOPPER FEEDER

[75] Inventors: Gary M. Garofano; Richard Lile; Jerald McBride; James Peterson; Gregory Nowak, all of Spokane, Wash.

[73] Assignee: R.A. Pearson Company, Spokane, Wash.

[21] Appl. No.: 08/971,279

[22] Filed: Nov. 17, 1997

[51] Int. Cl.[6] ..... B26D 7/06; B23P 21/00; B66C 23/00

[52] U.S. Cl. ..... 83/90; 414/728; 414/739; 414/783; 414/907; 414/798.5; 29/426.3; 29/798; 29/822; 83/91; 83/909; 83/935

[58] Field of Search ..... 83/909, 935, 91, 83/90; 414/783, 728, 739, 907, 798.5; 29/700, 822, 426.3, 798

[56] References Cited

U.S. PATENT DOCUMENTS

| | | | |
|---|---|---|---|
| 3,976,205 | 8/1976 | Goransson | 414/783 |
| 4,451,967 | 6/1984 | Stobb | 83/909 X |
| 4,541,763 | 9/1985 | Chandhoke et al. | 83/909 X |
| 4,835,836 | 6/1989 | Van Uitert | 83/909 X |
| 4,842,473 | 6/1989 | Zbornik | 414/783 X |
| 4,976,583 | 12/1990 | Moltrasio | 83/909 X |
| 4,995,784 | 2/1991 | Boisseau | 83/909 X |
| 5,039,081 | 8/1991 | Shill | 414/907 X |
| 5,139,387 | 8/1992 | Boldrini et al. | 414/795.8 |
| 5,190,430 | 3/1993 | Neri et al. | 83/909 X |
| 5,197,849 | 3/1993 | Tubke | 414/907 X |
| 5,211,529 | 5/1993 | Esala et al. | 414/795.8 |
| 5,238,355 | 8/1993 | Boldrini et al. | 414/797 |
| 5,447,410 | 9/1995 | Hast et al. | 414/907 X |

*Primary Examiner*—M. Rachuba
*Attorney, Agent, or Firm*—Wells, St. John, Roberts, Gregory & Matkin, P.S.

[57] ABSTRACT

Disclosed is a system which includes a method and apparatus for the removal of carton bundles from where they are stacked, such as on pallets, re-positions the carton bundles relative to a carton holding structure such as a hopper, removes the restraining strap(s) from each bundle and feeds the bundle or cartons onto a hopper.

6 Claims, 19 Drawing Sheets

DEPALLETIZER AND HOPPER FEEDER

TECHNICAL FIELD

This invention relates to a system which removes bundles of products, such as carton blanks, from a palletized stack, removes one or more encircling straps from each bundle, and then directs it to an awaiting hopper.

BACKGROUND OF THE INVENTION

There has been a long-felt but unsatisfied need in the packaging machinery industry for a system which effectively and reliably removes bundles of carton blanks or other sheet-like products from a pallet, and feeds the bundles into a hopper leading to associated machinery.

Prior to this invention, human machine operators had to lift such products from pallets and manually load them into a hopper. Requiring these functions to be performed manually: decreases production line efficiency; increases chances of injuries to operators; and results in a higher product cost.

The forenamed recognized needs have not heretofore been sufficiently fulfilled by existing packaging machinery.

It is therefore a primary object of this invention to provide an automated system for the removal of carton bundles from a where they are stacked, such as on a pallet, removal of the restraining straps encircling the bundles, and feeding of the carton blanks to a hopper.

It is a further object of this invention to provide such a system which removes and disposes of the straps encircling the bundles.

It is a still further object of this invention to provide such a system which can remove the bundles from any pallet or stack configuration or pattern, such as pinwheel stack patterns, column stacks, etc.

It is a still further object of this invention to provide such a system which can be used in combination with any one of a number of carton handling machines downstream, one example of which is a carton erector.

This invention achieves the foregoing objectives as set forth more fully herein.

BRIEF DESCRIPTION OF THE DRAWINGS

Preferred embodiments of the invention are described below with reference to the following accompanying drawings, which are briefly described below.

FIG. 4 is a simplified side elevation view of the apparatus;

FIG. 6 is a plan view of the bundle supply mechanism as seen generally along line 6—6 in FIG. 4;

FIG. 7 is an enlarged simplified view taken through the bundle transporter and looking toward one guide, as seen generally along line 7—7 in FIG. 5;

FIG. 10 is similar to FIG. 9 but shows the bundle transporter shifted to an operational station along the supporting framework;

FIG. 13 is similar to FIG. 12, but shows the shuttle discharging a strap into an awaiting chopper;

FIG. 14 is an enlarged view of the chopper assembly as seen in FIGS. 11–13;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

This disclosure pertains to automated equipment for discharging bundles of sheet-like products, such as carton blanks, from a palletized configuration of such bundles to an awaiting machine hopper. It depalletizes the bundles, opens each bundle, and directs the freed stacks of sheet-like products to an awaiting hopper that forms part of a related machine performing selected functions on the sheet-like products.

In the illustrated form of the invention, the sheet-like products are corrugated carton blanks. These are typically rectangular in nature, with cut and scored lines defining carton panels which are of significance as the individual cartons are subsequently erected.

It is to be understood that this invention can be utilized in handling various sheet-like products other than corrugated carton blanks. Other examples might be cardboard trays used in the packaging industry, and various forms of sheet-like end products which might be fed into a hopper for packaging or filling operations.

Figure 2:
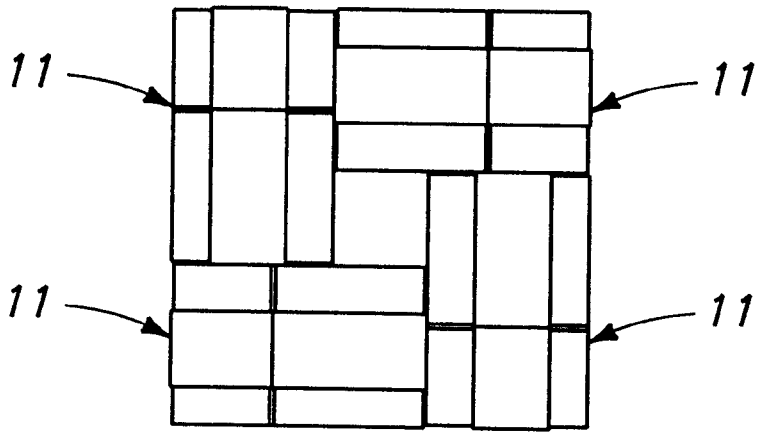
FIG. 2 is a diagrammatic plan view of palletized bundles arranged in a pinwheel configuration.
Figure 3:
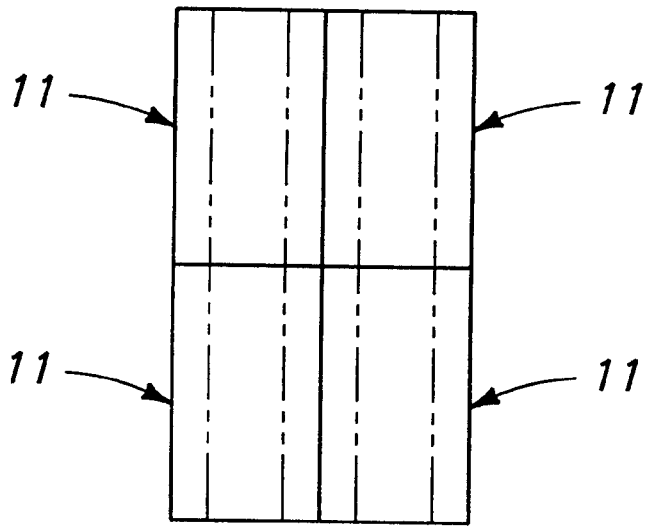
FIG. 3 is a diagrammatic plan view of palletized bundles arranged in a column stack configuration.

According to this invention, the sheet-like products are received in a palletized configuration of bundles stacked on a supporting pallet 13 (see FIG. 4). The specific palletized configuration of bundles is immaterial to an understanding of the present equipment, which can be programmed to receive the bundles from any conventional palletized load. Two examples of conventional palletized patterns of bundles used in the carton industry are illustrated in FIGS. 2 and 3, which show the upper layer of bundles arranged in a pinwheel stacked configuration and a column stacked configuration, respectively. In each of these figures, the individual bundles are designated by the reference numeral 11.

It is to be understood that the palletized configuration includes multiple layers of a similar shape, with successive layers either being identical to one another, or staggered in position to interlock the bundles of one layer to the those of the next. The palletizing of such bundles is well known, and need not be further developed herein for an understanding of the present invention.

Figure 1:
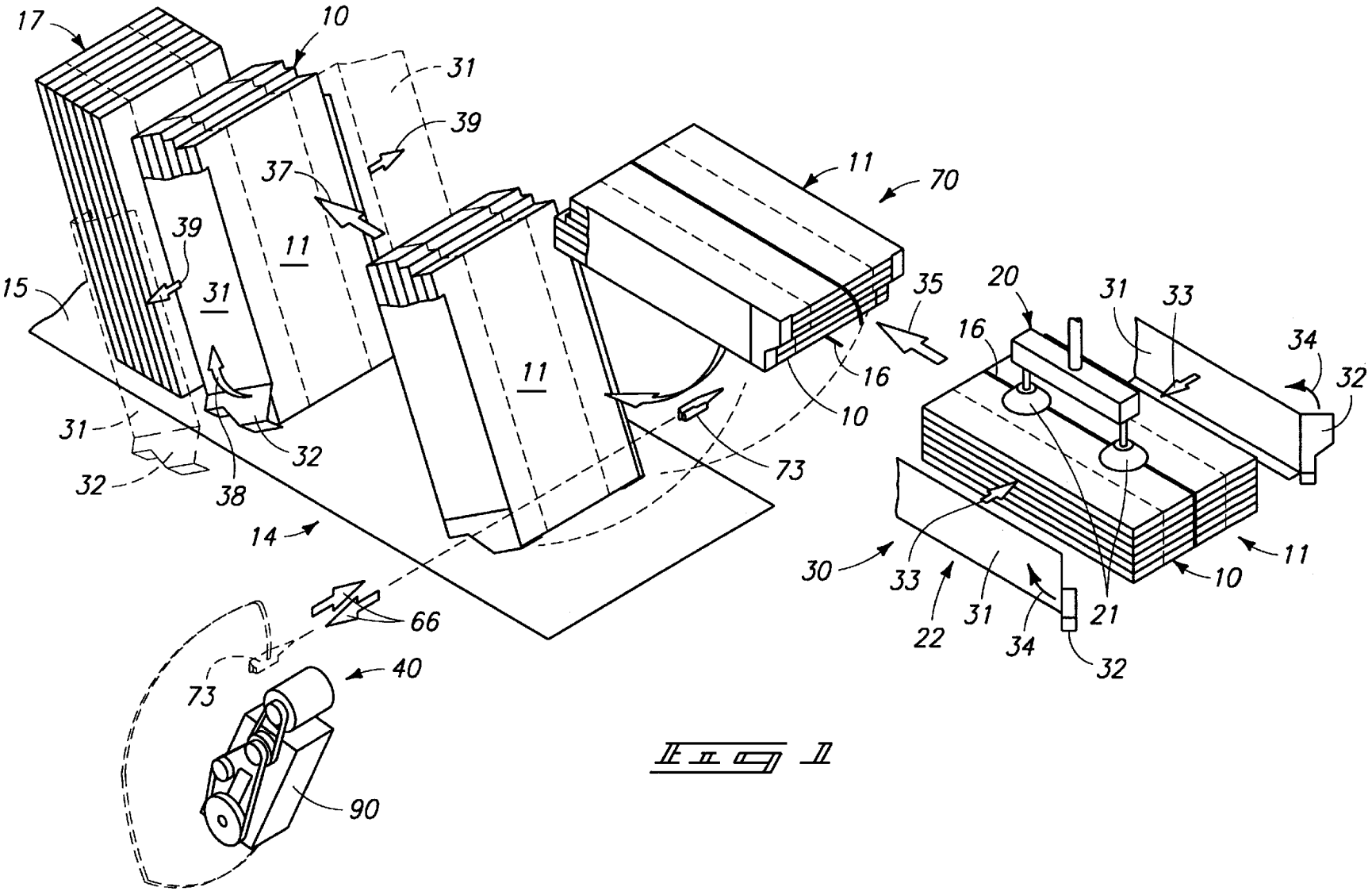
FIG. 1 is an exploded diagrammatic perspective view illustrating the basic components and operations of this disclosure.

FIG. 1 diagrammatically illustrates the essential operational and structural features of the invention. At the right hand side, a bundle supply mechanism 20 utilizes selectively operable vacuum cups 21 to grasp individual bundles 11. The bundle supply mechanism 20 is operably mounted on a supporting framework (not shown in FIG. 1) for vertical, transverse and longitudinal motion relative to the framework and for rotation about a vertical axis centered between vacuum cups 21 during handling of each bundle 11.

The bundles are individually positioned at a bundle transfer station 22. One or more encircling straps 16 about each bundle 11 are aligned longitudinally along the framework in the direction generally shown from right to left in FIG. 1. The straps 16 are typically flat strips of plastic wrapped tightly about the individual bundles 11 and permanently sealed for handling purposes.

A bundle transporter 30 has a pair of transversely movable guides 31 positioned to openly receive an individual bundle located at the bundle transfer station 22 by the bundle supply mechanism 20. The bundle transporter 30 further includes hinged gates 32 at one open end of each guide 31. The gates 32 swing between an open position and an operational or closed position across the related surfaces of the guides 31. The bundle transporter 30 contracts guides 31 toward one another to support each bundle 11 when it is released by the vacuum cups 21. The closing action of guides 31 is indicated by arrows 33. The related closing pivotal movement of gates 32 is illustrated by arrows 34.

Prior to shifting the location of each bundle 11, a portion of the sheet-like products 10 within each bundle 11 is moved longitudinally toward the closed gates 32. This results in an elevational step being formed within the bundle, as illustrated in the bundle shown at operational station 70. The resulting gap between the encircling strap 16 and the stack of sheet-like products (carton blanks) facilitates entry of a cutter guide 73 that fits between the sheet-like products and within a bundle 11 and a strap 16 encircling it. The directions of movement of the guide 73 are illustrated by arrows 66.

After each bundle 11 is supported within the bundle transporter 30, it is moved longitudinally relative to the supporting framework, as illustrated by arrow 35. This movement shifts the location of each bundle 11 from the bundle transfer station 22 to an operational station 70 that is longitudinally displaced from the bundle transfer station 22.

The downstream end of each bundle 11 is longitudinally indexed or located relative to the supporting framework when it stops at the operational station 70. This indexing facilitates accurate entry of the moving guide 73 within the space between the stepped stack and the encircling strap 16.

The cutter guide 73 is on a movable shuttle which grasps a strap 16, severs it, and then carries the strap to a powered chopper 90 on the machine framework. Chopper 90 reduces the elongated strip to small pieces, which can be discarded or recycled.

When utilized to feed the sheet-like products onto the conveying surface 15 of a horizontal machine hopper 14, the bundle transporter 30 is first pivoted to a downwardly inclined attitude from its horizontal attitude at the operational station 70. The bundle transporter 30 is then moved longitudinally toward the exiting sheet-like products 10 supported upon the conveying surface 15. The sheet-like products, such as in the form of carton blanks 10, are shown in an exiting position in FIG. 1, as indicated by using the reference numeral 17. The longitudinal motion imparted to the inclined bundle 11 is indicated by arrow 37.

As the incoming bundle 11 engages the exiting array of stack of sheet-like products 17, bundle transporter 30 will encounter resistance to its continued longitudinal movement. This resistance is detected by a detecor assembly, and results in termination of the longitudinal movement after first crowding the existing stack of sheet-like products 17 into an abutting condition.

After longitudinal motion of the bundle transporter 30 has been completed, the gates 32 are opened (see arrow 38) to permit the sheet-like products 10 within bundle 11 to slide into contact with the conveying surface 15. Guides 31 are then spread apart, as illustrated by arrows 29, to leave the bundle transporter 30 clear for subsequent upward pivotal movement back to its horizontal position in readiness for receipt of the next bundle 11 discharged from the bundle supply mechanism 20. The guides 31 and gates 32 are closed while elevationally below the vacuum cups 21 at the bundle transfer station 22. By closing as an incoming bundle 11 is dropped between them, the guides 31 and gates 32 assist in positioning the bundle and facilitate its smooth receipt in the bundle transporter 30.

The above overview of this equipment and its operation will be detailed in the following description. It is to be understood that the specific details that will be described, and which are illustrated in the accompanying drawings, show the current form of the invention. These details illustrate application of the invention to equipment specifically designed for delivering bundled carton blanks to the horizontal hopper assembly of other associated equipment, such as a carton erector.

The concepts of this invention and its components have broader application to delivery of sheet-like products to any form of hopper, whether horizontal, vertical, or inclined. For instance if the receiving hopper is a vertical hopper, the bundle transporter 30 would not need to be pivotally mounted. It might directly drop the sheet-like products within a bundle into an awaiting hopper inlet. It alternatively might be mounted for downward elevational movement while remaining at a horizontal attitude to deliver the products in a more controlled manner.

In addition, the strap removal assembly 40 has applications to other types of equipment wherein bundled stacks of products must be released from encircling straps in order that functions might be carried out on the products.

Other types of bundle supply mechanisms can be substituted in place of the type of mechanism specifically illustrated which uses selectively operated vacuum cups to lift and drop the bundles 11. The depalletizer might be a separate machine coupled to the hopper feeder by a connecting conveyer that would discharge the individual bundles into the awaiting bundled transporter 30 that would feed them into a receiving hopper.

These and other variations of the disclosed concepts and mechanisms will be evident from a study of the following detailed description of the preferred embodiment.

Figure 5:
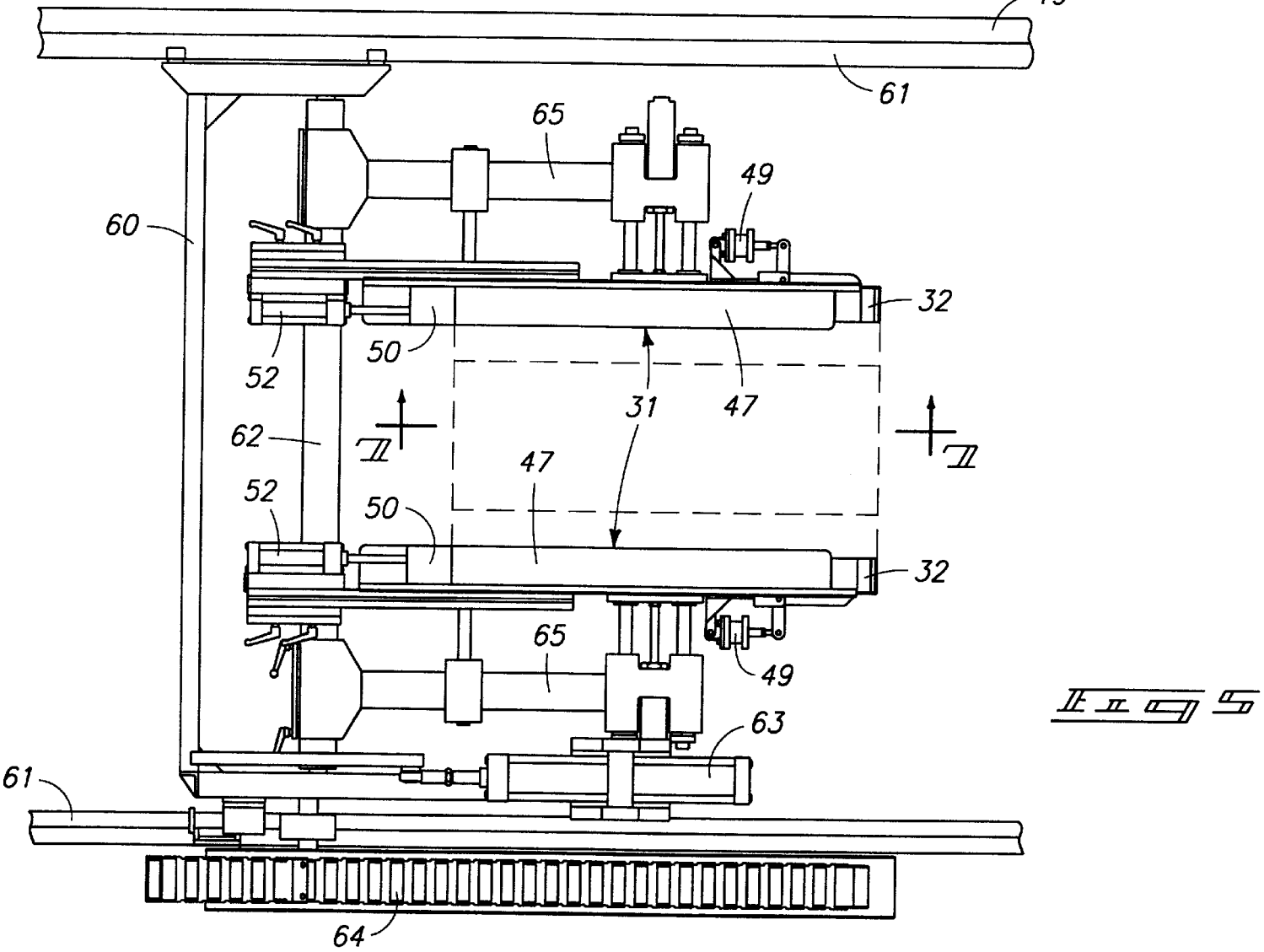
FIG. 5 is a more detailed plan view of the bundle transporter, as seen generally along line 5—5 in FIG. 4.
Figure 11:
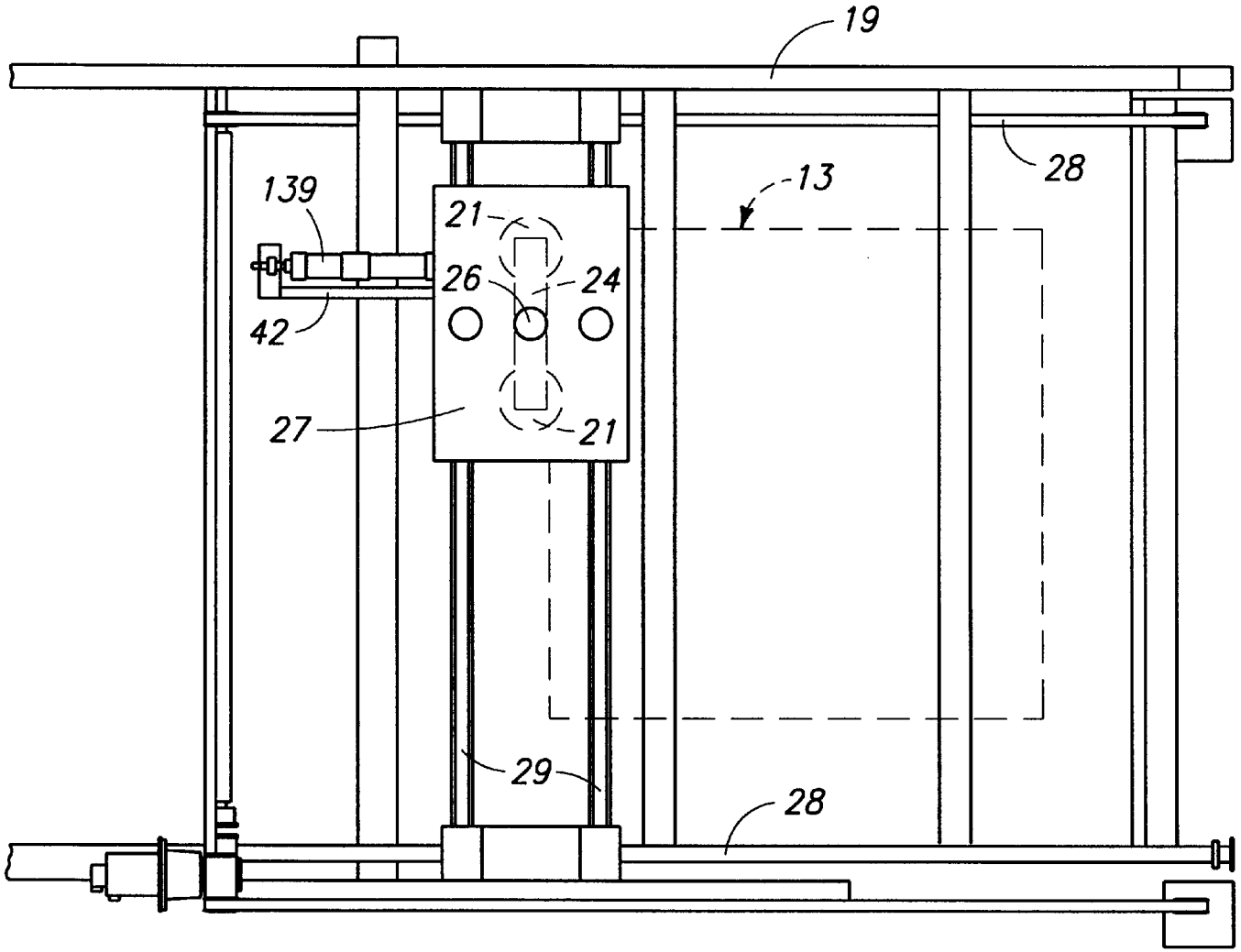
Figure 11:
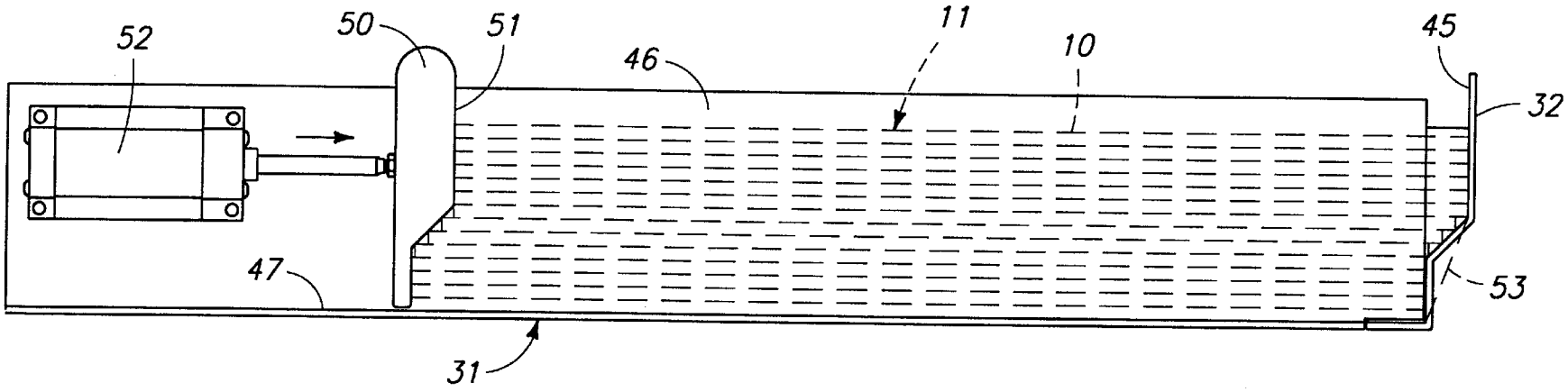

A general overview of the present equipment can be obtained by a study of FIGS. 4–6. FIG. 4 shows the longitudinal relationship of the components generally discussed above. FIG. 5 shows a plan view of the empty bundle transporter 30, and FIG. 6 shows a plan view of the bundle supply mechanism.

The illustrated equipment was specifically designed for depalletizing and feeding corrugated carton blanks to an associated machine 25 that carries out operations on each blank, such as carton erection, filling of the erected carton, and sealing of the erected or filled carton. In this example, the incoming carton blanks 10 are directed to an associated machine 25 on a horizonal feed hopper 14. Details of one specific form of such a horizontal hopper are contained in U.S. Pat. No. 5,211,529, issued May 18, 1993, which is hereby incorporated into this disclosure by reference.

The equipment of the present invention is supported on a rigid fixed framework shown at 19. Incoming pallets 13 are carried on framework 19 by a pallet elevator mechanism 23. The elevator mechanism 23 sequentially lifts each pallet 13 to position the top bundles 11 in the palletized configuration of bundles 12 at an elevation from which they can be engaged and lifted by vacuum cups 21.

Referring to FIGS. 4 and 6, the illustrated pair of vacuum cups 21 are suspended from a transverse support 24. The support 24 is moved elevationally up and down by a powered cylinder assembly 26 mounted to a support platform shown generally at 27. The support 27 is longitudinally guided on framework 19 by elongated rods 28. It is transversely guided by perpendicular rods 29 on end carriages that move along the rods 28.

Platform 27 further includes a mechanism for rotating the vacuum cup support 24 about its central vertical axis (centered through the cylinder assembly 26). In one specific embodiment, rotational movement is controlled by back-to-back cylinders 139 and an interconnected rack 42 that meshes with a gear (not shown) on the central shaft that suspends the vacuum cup support 24.

In general, the vacuum cups 21 of the illustrated bundle supply mechanism 20 are mounted on framework 19 for vertical, transverse, and longitudinal motion relative to the framework and for rotation about a vertical axis. This freedom of movement permits the vacuum cups to engage any bundles in a palletized configuration of bundles 12 regardless of the position or orientation of the specific bundle 11 being handled, while assuring that each bundle 11 will be discharged at the bundle transfer station 22 at an identical elevation and longitudinal orientation. In order to accommodate the various orientations of carton blank bundles on a pallet, the vacuum cups 21 should have a range of pivotal movement extending through 270 degrees. Such movement is preferably accomplished in 90-degree increments.

While the vacuum cups 21 are illustrated in the drawings as being angularly oriented either transversely or longitudinally relative to the frame 19, in many instances it will be necessary to offset them slightly from such an orthogonal orientation. This allows the vacuum cups 21 to engage carton blanks or other sheet-like products having apertures or slots that might otherwise interfere with the establishment of a lifting vacuum on the top surface of the bundle.

Each bundle 11 is carried by the gripping vacuum cups 21 to a transversely centered position within the frame 19 where it is angularly pivoted to an orientation in which strap 16 is oriented longitudinally or parallel to the length of framework 19. This location along the framework 19 is referred to herein as the "bundle transfer station".

At the same time that each bundle 11 is being removed from pallet 13, the bundle transporter 30 is moving along framework 19 from left-to-right in FIG. 4. This movement occurs following the return of the bundle transporter 30 to its horizontal position. It results in bundle transporter 30 being located as shown in FIG. 4 at the bundle transfer station 22.

When bundle transporter 30 stops at the bundle transfer station 22, vacuum is released at the vacuum cups 21, thereby permitting a bundle 11 to drop between the guides 31 as the guides 31 and gates 32 are moving to their respective closed positions.

Figure 8:
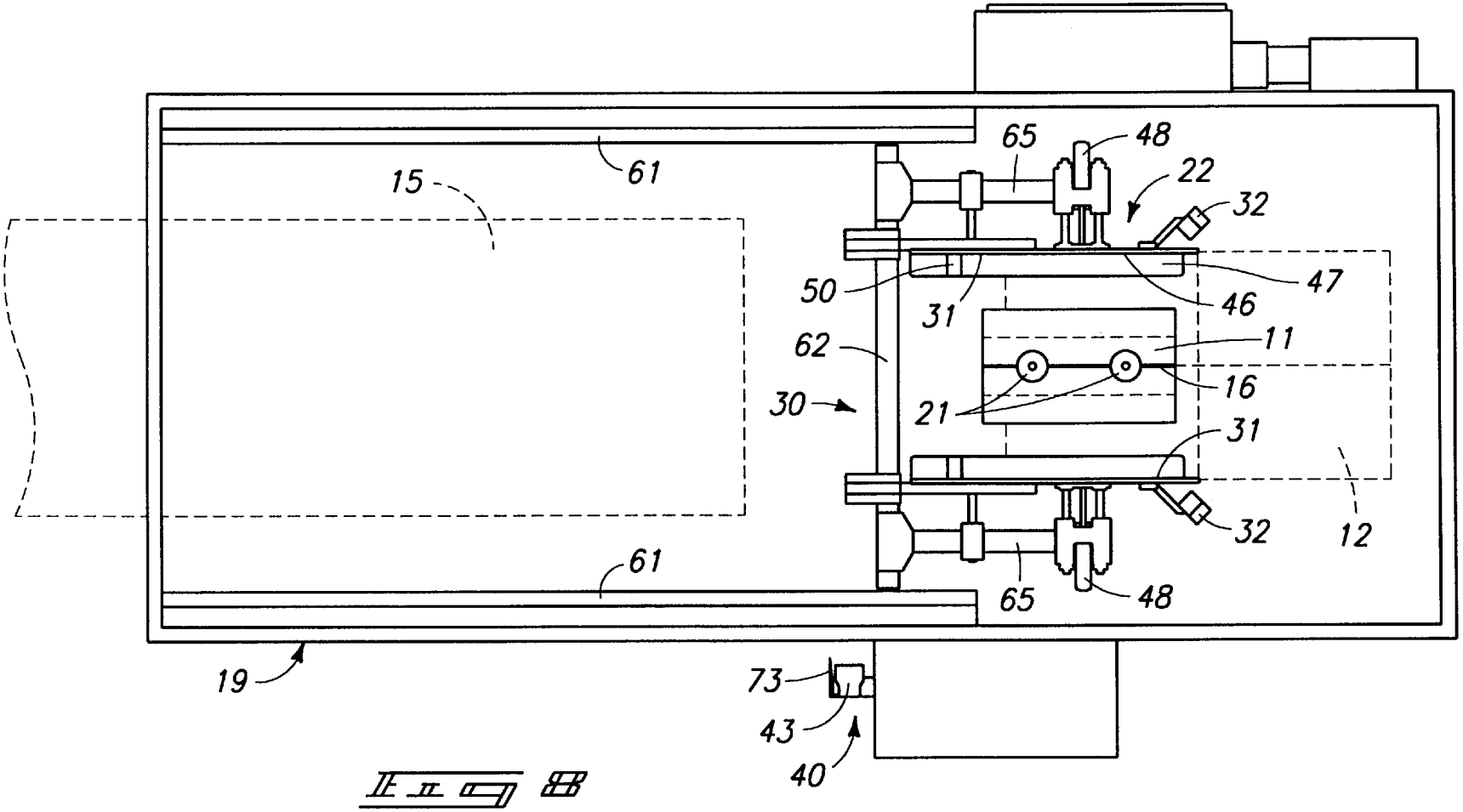
FIG. 8 is a simplified plan view looking downwardly at the bundle transporter and supporting frame elements, the bundle transporter being shown in an expanded configuration while located at the bundle transfer station for illustrative purposes only.
Figure 9:
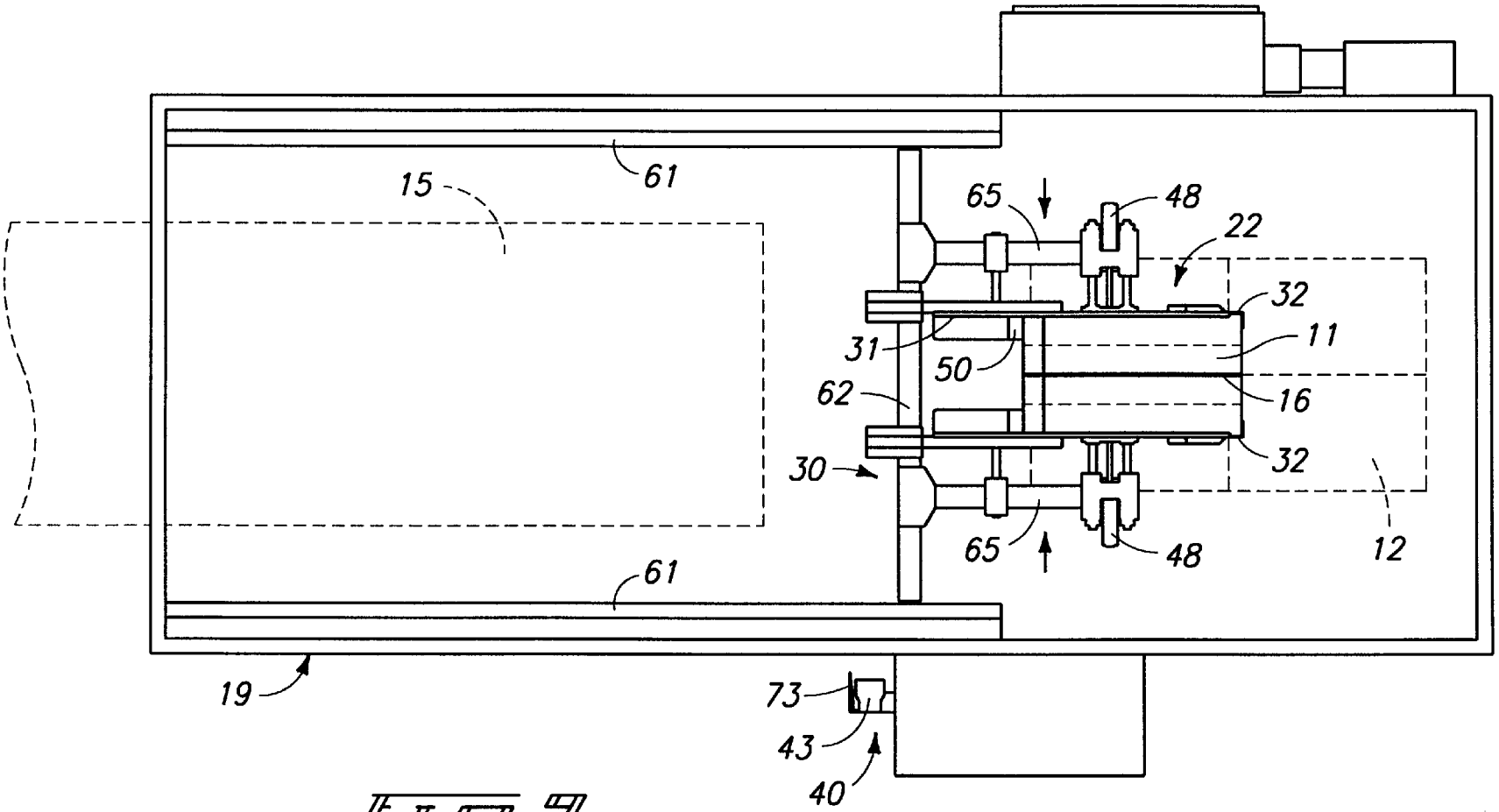
FIG. 9 is similar to FIG. 8, but shows the bundle transporter in a contracted configuration.
Figure 11:
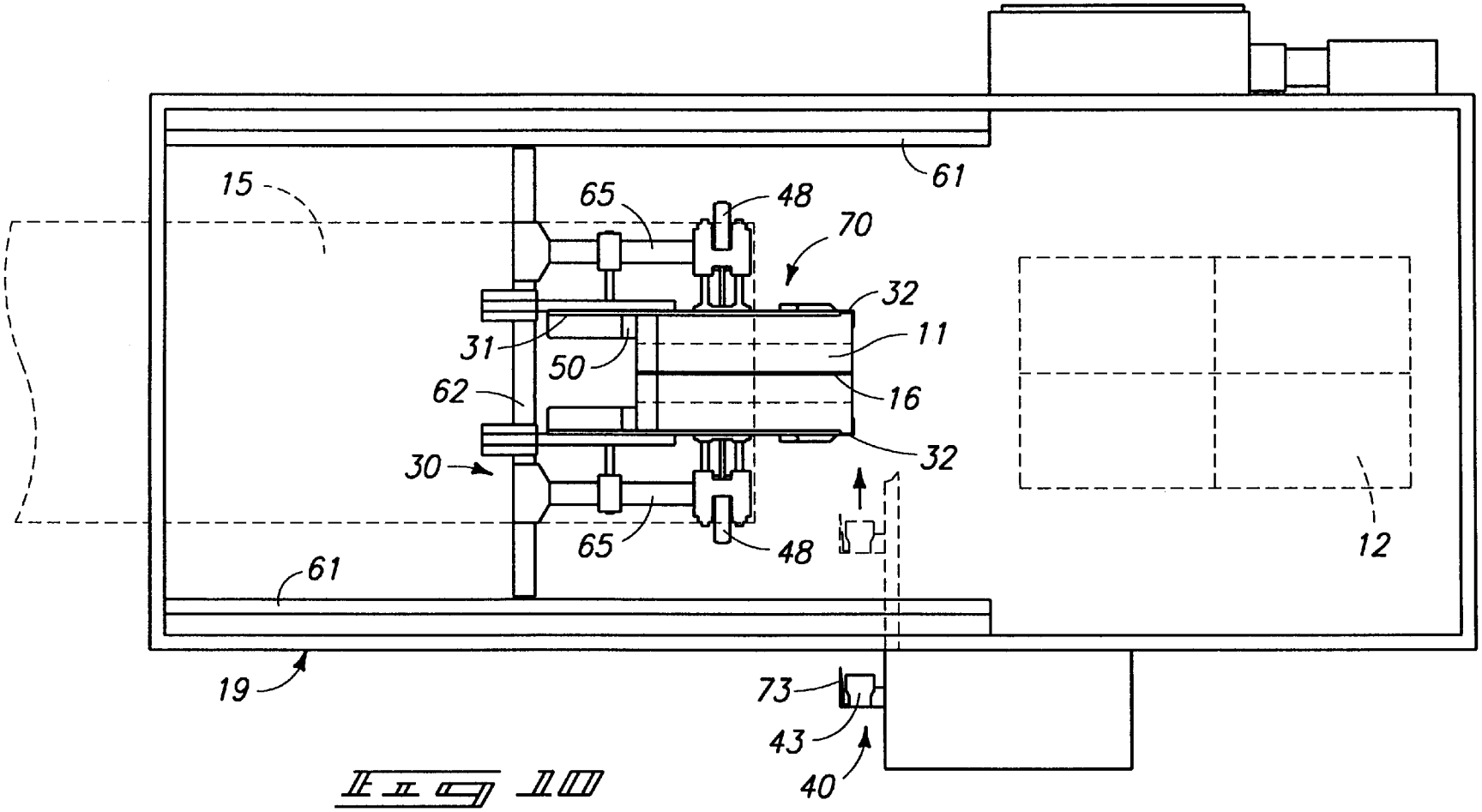
Figure 11:
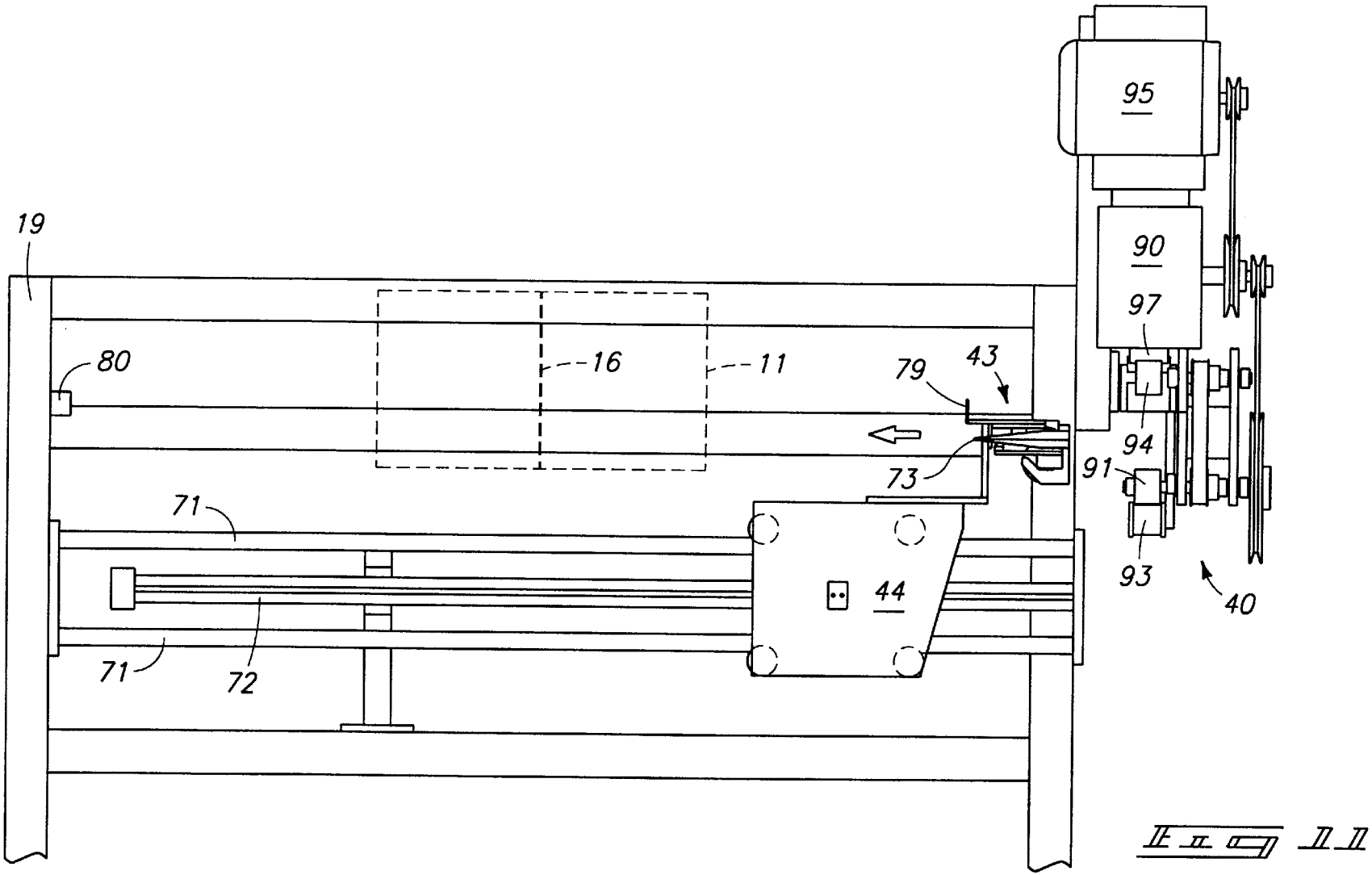

The general operations taking place at the bundle transfer station 22 are schematically illustrated in FIGS. 8, 9 and 10.

Each guide 31 typically includes a pivoted end gate 32 adjacent to one transverse end of each bundle received between the guides 31. Each gate 32 is movable relative to the guides 31 between an open position clear of the guides (FIG. 8), and a closed position intersecting them (FIGS. 9 and 10).

The gates 32 each have inner surfaces adjacent to and facing toward the one transverse end of each bundle 11. The shape of these inner surfaces, designated by the numeral 45, can best be seen in the simplified diagrammatic view of FIG. 7. The inner surfaces 45 are longitudinally offset or stepped at an elevation intermediate their respective heights. As can be seen in FIG. 7, this causes individual carton blanks 10 to be shifted within a bundle 11 into a longitudinally offset pattern when the blanks 10 are pushed to the right. The resulting step across the one end of each bundle creates a gap between the lowermost carton blanks 10 and strap 16, as indicated by line 53 in FIG. 7. This gap facilitates entry of a transverse shuttle 43 to engage and sever the strap 16, as will be detailed below.

Further details concerning the bundle transporter 30 can be seen in FIG. 5. Each bundle transporter 30 is carried on a rigid frame 60 that rolls along longitudinal rails 61 on the main framework 19. Longitudinal movement can be imparted to the frame 60 by an interconnected chain 64 or other suitable conventional mechanism for shifting the longitudinal position of frame 60 relative to framework 19.

Frame 60 pivotally carries a transverse shaft 62 rigidly fixed to arms 65 that extend parallel to the respective guides 31. The arms 65 elevationally support guides 31, which are movable relative to shaft 62 and arms 65 to open or close in the manner previously described. In addition, frame 60 carries a power cylinder assembly 63 operably connected to the shaft 62 to pivot the bundle transporter about a transverse horizontal axis through the center of shaft 62.

As can be seen in FIG. 4, the bundle transporter 30 is pivoted between the horizontal position at which bundles are received within guides 31 at the bundle transfer station 22 and a lowered inclined orientation referred to herein as a "discharge angular position". The discharge angular position of the bundle transporter 30 is illustrated in dashed lines at the center of FIG. 4, and is further developed in FIGS. 21 and 22.

As can be seen in FIGS. 7–10, each guide 31 comprises an elongated longitudinal member having an upright longitudinal surface 46 and a perpendicular transverse inner surface 47. The surfaces 46 on the guides 31 face toward one another. Surfaces 47 extend toward one another to form a supporting shelf for receipt of a bundle discharged by the vacuum cups 21. In combination, the surfaces 46 and 47 form a longitudinal support to receive, guide and carry the bundle 11 deposited upon the guides 31 as it moves relative to framework 19.

The guides 31 are moved toward or away from one another by individual power cylinders 48 on the bundle transporter 30. The cylinders 48 can be replaced by any suitable mechanism for moving the guides 31.

Gates 32 are pivoted by operation of small cylinders 49 on the bundle transporter 30 (See FIG. 5). Other mechanisms can be substituted as desired.

Because each incoming bundle 11 is loosely dropped from gripping vacuum cups 21 into the space between the guides 31, its resulting longitudinal position is not accurate relative to framework 19 or bundle transporter 30. In order to index one transverse end of each bundle (to the right in FIGS. 8–10) relative to the bundle transporter 30, a bundle positioning mechanism is movably mounted relative to guides 31 in a longitudinal direction. This bundle positioning mechanism is shown as upright blocks 50 that slide along guides 31 in contact with their upright longitudinal surfaces 46 and transverse surfaces 47.

As can be seen in FIG. 7, the inner surfaces 51 of block 50, which face toward gate 32, are complementary in shape to the inner surfaces 45 of each gate. This facilitates shifting of individual carton blanks 10 as previously described, and as illustrated in FIG. 7.

Each block 50 is powered by a cylinder assembly 52 operably connected between its supporting guide 31 and the block 50. Blocks 50 are retracted in unison for receipt of an incoming bundle (FIG. 8), and are extended in unison toward the gates 32 after a bundle is received between the guides 31 (FIG. 9). The extension of inner face 51 of blocks 50 not only staggers the longitudinal positions of the carton blanks 10, but also longitudinally indexes the transverse end of each bundle as it abuts the gates 32.

The next step in processing a bundle 11 by means of this equipment involves moving the bundle transporter 30 longitudinally and to the left as seen in FIGS. 4 and 8–10. During this movement, the bundle transporter 30 and its guides 31 remain in a horizontal attitude. The powered equipment on framework 19 shift the bundle transporter 30 to the position illustrated in FIG. 10. For purposes of the present description, this intermediate position of the bundle transporter shall be termed its "operational station", indicated in the drawings by numeral 70. At this station 70, the strap or straps 16 encircling the bundle 11 are severed and removed. Also, before the bundle transporter 30 again moves longitudinally, it is pivoted downwardly to its "discharge angular position", which is illustrated in dashed lines in FIG. 4.

Longitudinal movement of bundle transporter 30 to the operational station 70 indexes the one end of each bundle 11 abutting the gates 32 with an adjacent strap removal assembly 40.

Figure 16:
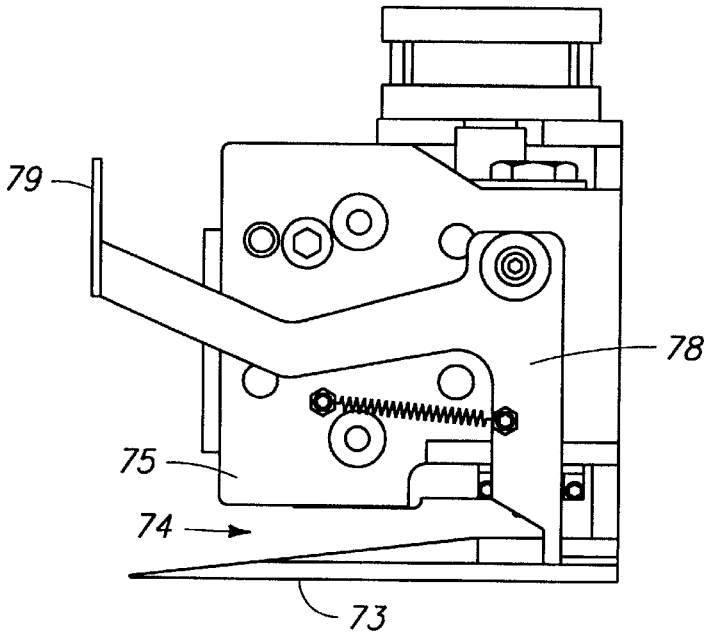
FIG. 16 is an enlarged plan view of the strap-engaging and severing shuttle.
Figure 17:
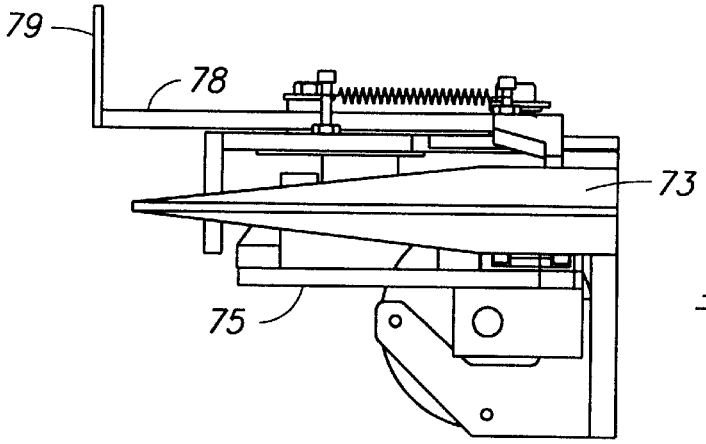
FIG. 17 is a side elevation view of the shuttle.

The strap removal assembly is mounted on framework 19 for selectively severing and disposing of the strap or straps 16 encircling each bundle 11. Details of the strap removal assembly 40 are best seen in FIGS. 11 through 15. The transversely movable shuttle that engages the straps is detailed in FIGS. 16 through 18.

Figure 11:
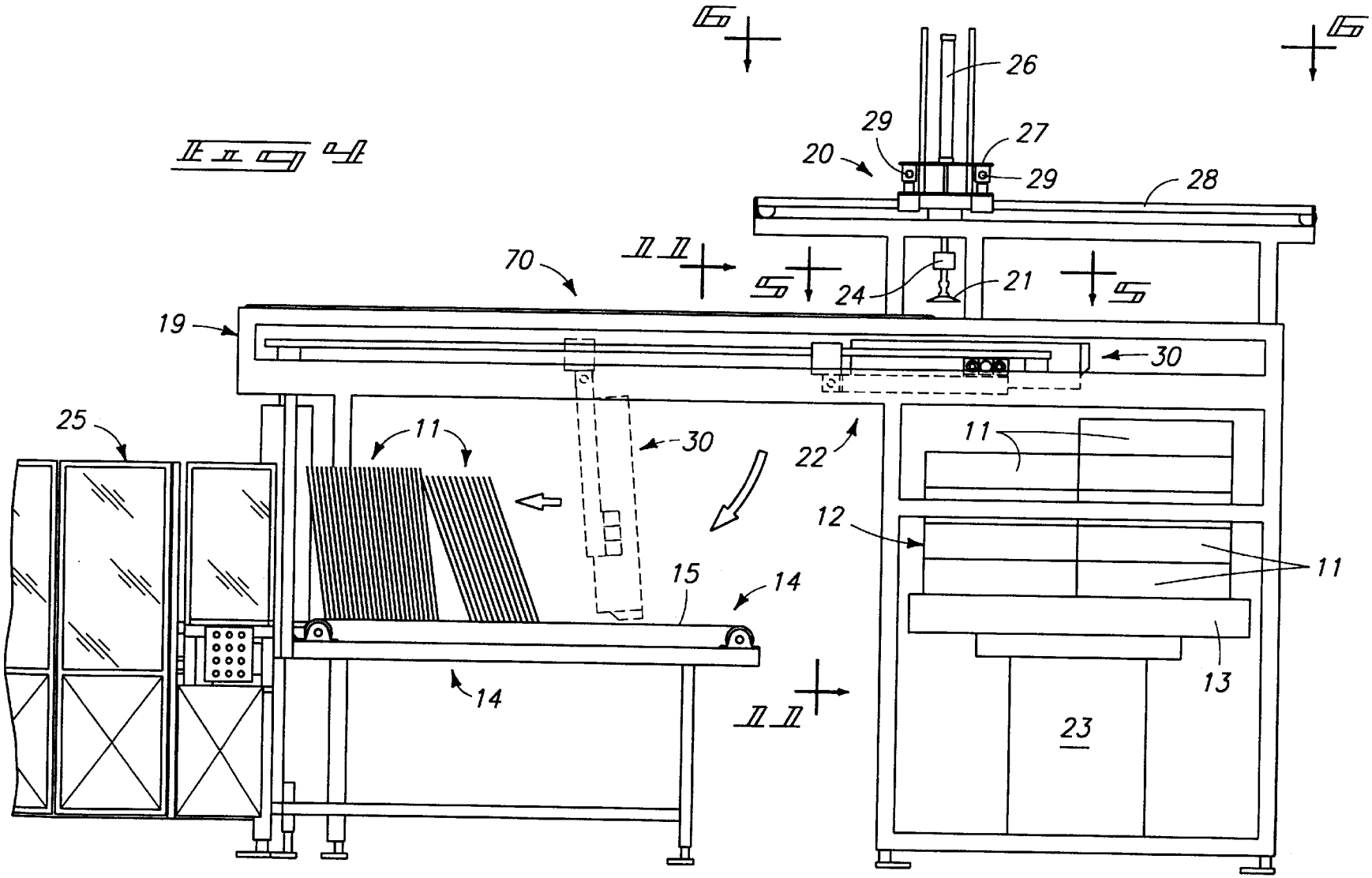
FIG. 11 is a transverse elevational view illustrating the features of the strap removal assembly, as seen generally along line 11—11 in FIG. 4.
Figure 12:
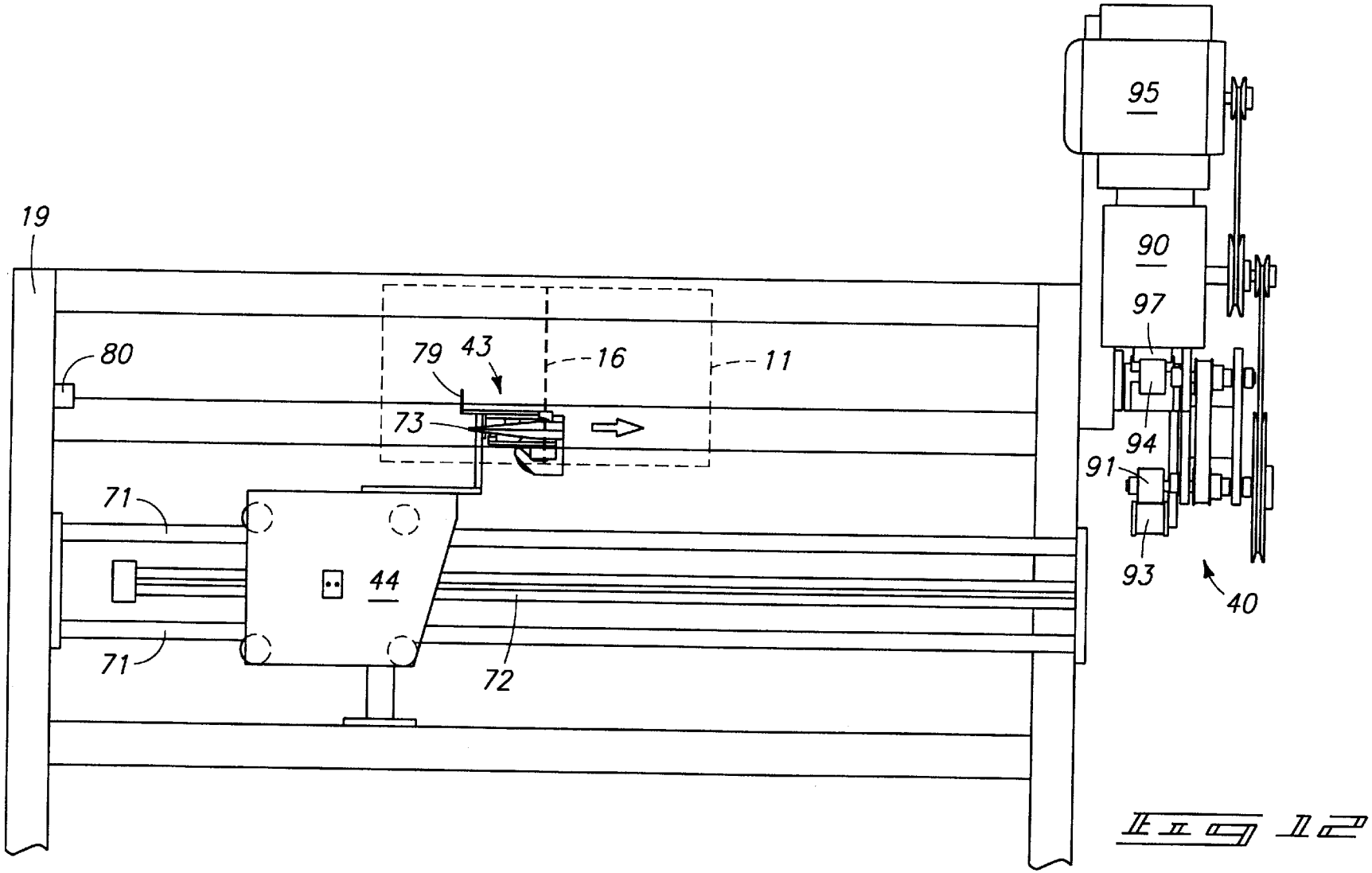
FIG. 12 is similar to FIG. 11, but shows the transversely movable shuttle engaging a bundle strap.
Figure 11:
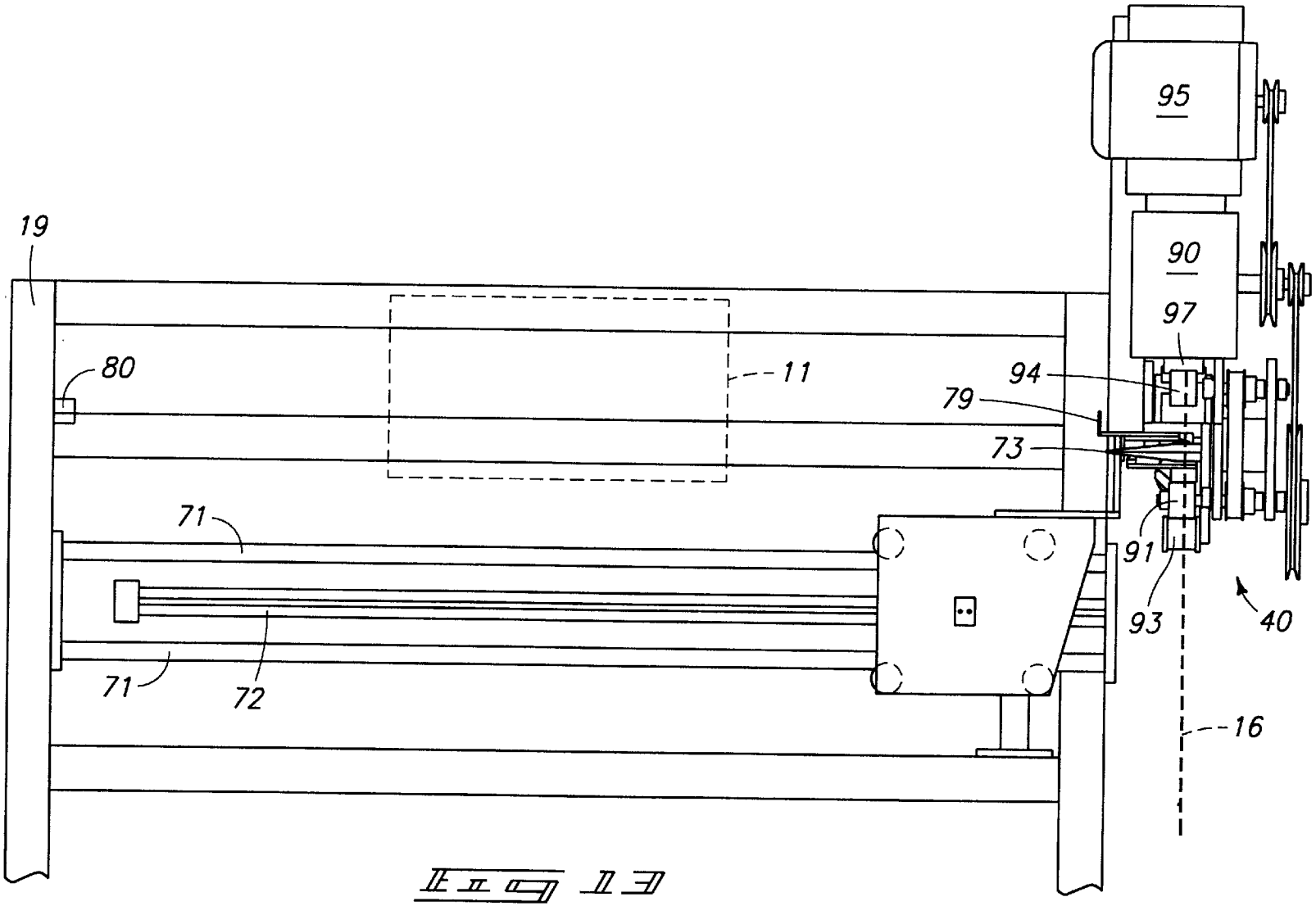
Figure 11A:
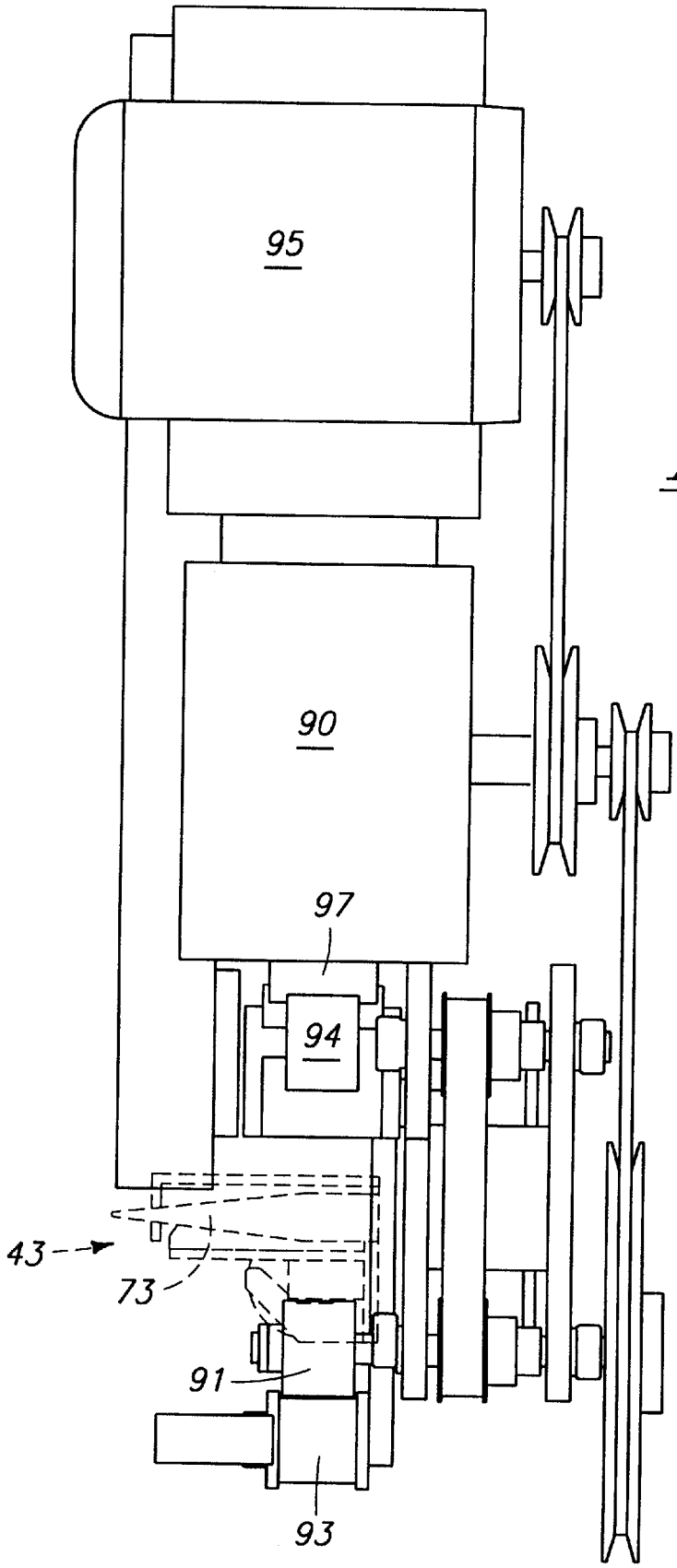

Referring to FIGS. 11 through 13, the shuttle 43 and its supporting carriage 44 are illustrated in a neutral position in FIG. 11. FIG. 12 shows the shuttle 43 at a location engaging a strap 16 encircling a bundle 11. FIG. 13 shows the shuttle 43 moved to the right to deliver the strap into a chopper 90 that disposes of it.

Shuttle 43 is movably carried on a supporting carriage 44 having rollers that ride along transverse rods 71 on the framework 19. Carriage 44 is interconnected to a powered cylinder assembly 72 arranged across the framework 19. The controllable carriage 44 shifts the transverse position of carriage 44 and the shuttle 43 as required by operation of the equipment.

Figure 18:
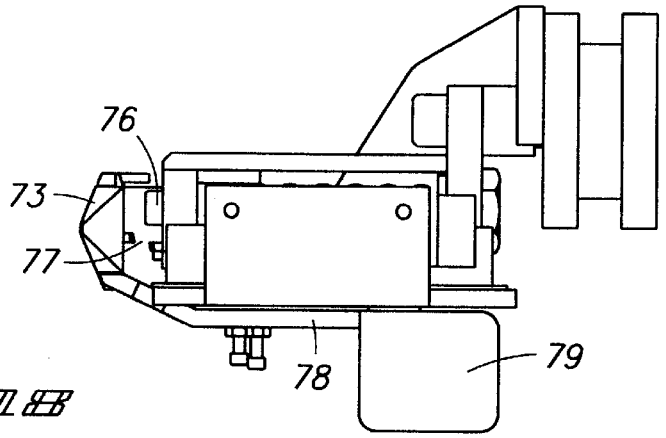
FIG. 18 is an elevational end view of the shuttle as seen from the left in FIG. 17.

The shuttle 43 includes an elongated tapered guide 73 that defines an open throat 74 between it and a supporting shuttle frame 75. Located within the shuttle frame 75 is a cylinder (not shown) that moves a plunger 76 in opposition to the inner surface of guide 73 (FIG. 18). Plunger 76 moves from the position shown in FIG. 18 to an extended position in abutment with the opposing surface of guide 73. Aligned with the plunger 76 is a shear 77, which is operated by the same cylinder as planger 76.

A crank 78 is pivoted to the shuttle frame 75 and extends across the throat 74 adjacent to the plunger 76 and shears 77. One arm of the crank 78 carries a reflector 79 which works in conjunction with a photocell 80 on frame 19 aimed toward the reflector 79 (FIG. 11).

In operation, carriage 44 propels shuttle 43 to the left as seen in FIG. 11. Its motion across the framework 19, permits the tapered guide 73 to enter the small open space formed between strap 16 and bundle 11 due to the longitudinal offset of the carton blanks, as indicated in FIG. 7 by dashed line 53. When the strap 16 engages the crank 78 within the throat 74, the resulting deflection of reflector 79 is detected by photocell 80, which then sends a signal to the operating controls for the machine, resulting in stoppage of carriage 44.

At this time, plunger 76 is extended to act as a clamp to securely grip the strap 16 on the shuttle frame 75. Shears 77 are then activated to sever each strap 16 while it remains gripped by the plunger 76. In this way, the strap is first gripped and then severed, thereby permitting controlled removal of the severed strap, which would otherwise "fly" freely about the machine due to its released tension.

Once the severed strap 16 is gripped by the plunger 76, it is carried to the right of framework 19 to the position shown in FIG. 13. It is then delivered to a chopper 90. The general details of the chopper can best be understood in FIGS. 14 and 15.

Figure 15:
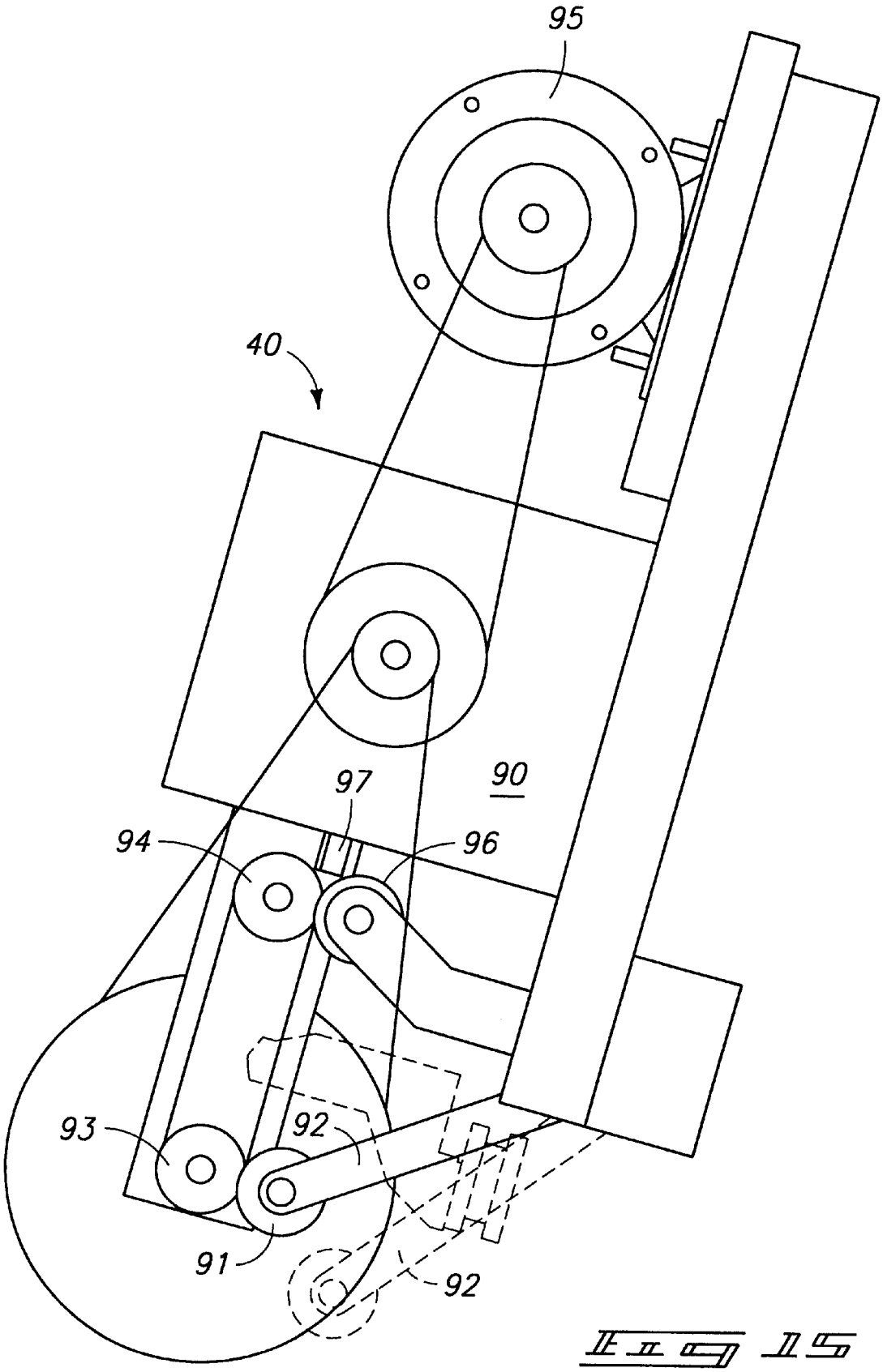
FIG. 15 is a side elevation view of the chopper assembly shown in FIG. 14.

Chopper 90 is fixed to the framework 19 in an inclined orientation similar to that of the shuttle frame 75. FIG. 15 shows this inclination, and illustrates the complementary position of shuttle frame 75 in dashed lines.

Chopper 90 is provided with a roller feed mechanism designed to engage each strap delivered to it while hanging downwardly from the shuttle frame 75. This mechanism includes a movable roller 91 carried by a pivoted arm 92 and powered rollers 93 and 94 that are selectively rotated by controlled operation of a motor 95. Powered roller 94 is frictionally engaged by an opposed idler roller 96. The rollers 94 and 96 are located immediately below an open throat 97 leading to the interior of chopper 90. The chopper itself can be any form of device for shredding, grinding or otherwise treating the straps 16 to reduce them in size for disposal or recycling.

Figure 19:
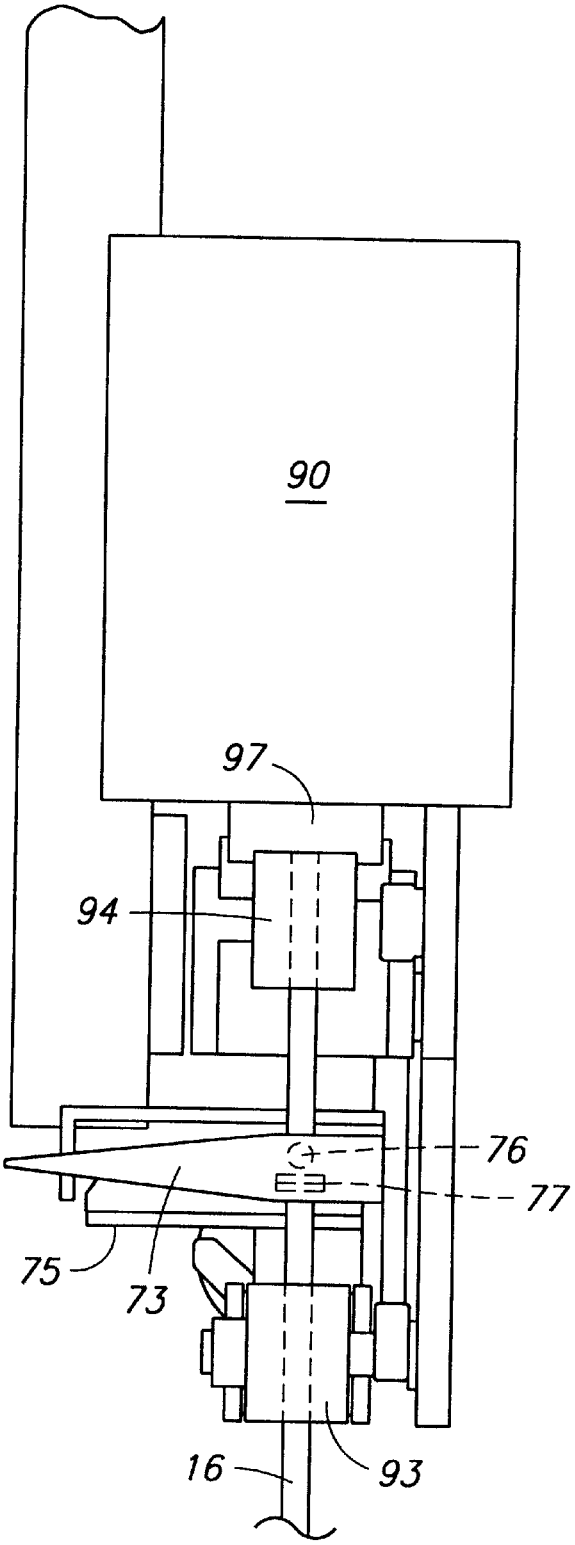
FIG. 19 is a simplified view of the chopper assembly and shuttle, similar to FIG. 14.
Figure 20:
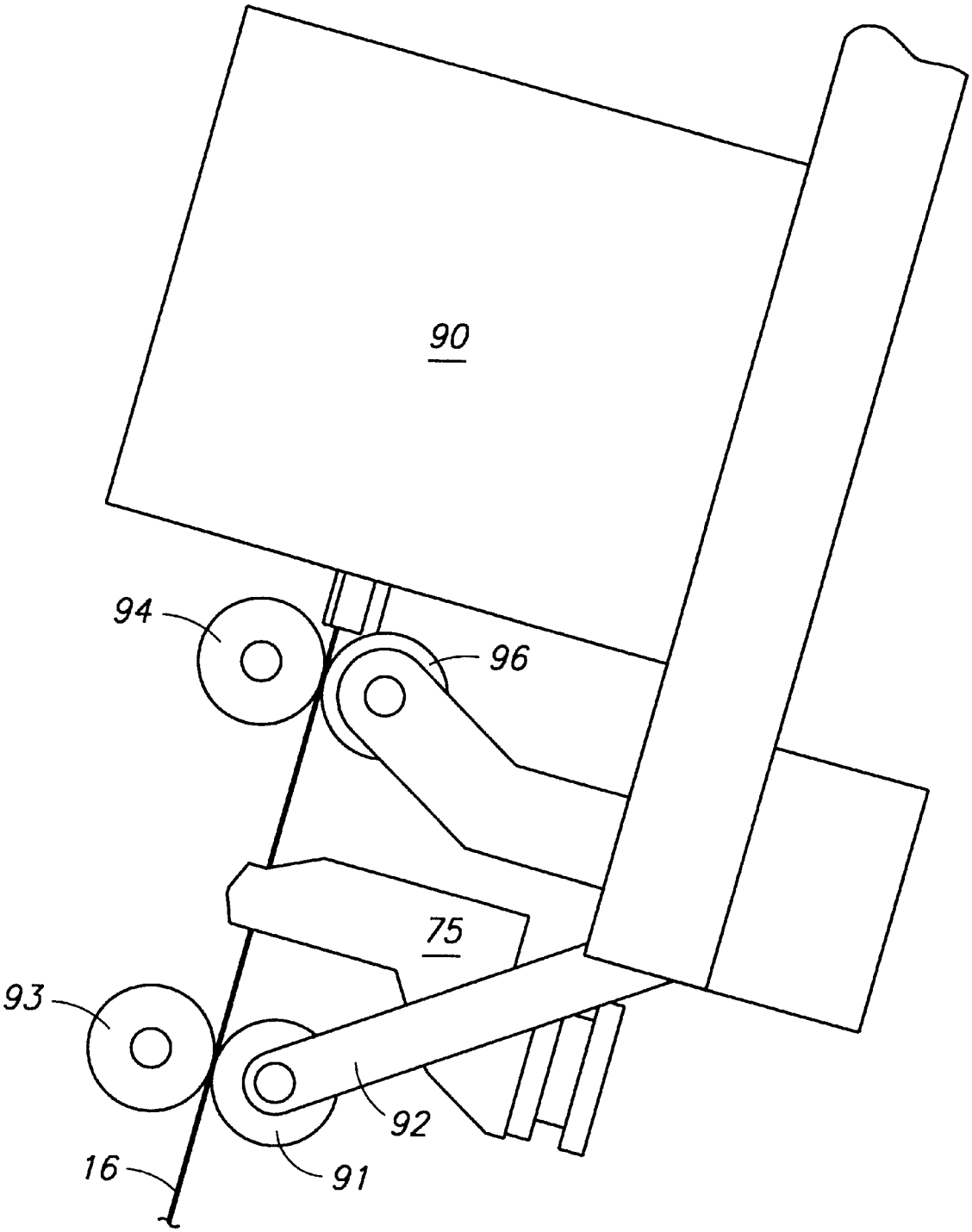
FIG. 20 is another simplified view of the chopper assembly and shuttle, similar to FIG. 15.

The general features of the elements on framework 19 that are associated with chopper 90 are shown in more simplified diagrams in FIGS. 19 and 20. If there are more than one strap 16 encircling a bundle 11 at the operational station 70, the shuttle 43 will move back and forth across framework 19 to individually sever each strap and carry it to the chopper 90 as just described.

After removal of the longitudinal strap(s) 16 encircling each bundle 11, the bundle 11 is pivoted downwardly about the axis of shaft 62. This occurs at the operational station 70 and prior to any further longitudinal movement of the bundle transporter to the left (see FIGS. 4 and 21). To effect this motion, cylinder assembly 63 is operated to selectively pivot the bundle transporter 30 about its transverse horizontal axis, which in turn shifts the supported bundle 11 within it from the operational station to a discharge angular position indicated in the drawings by the numeral 100.

At the discharge angular position, individual carton blanks within each bundle 11 are held by guides 31 in an angular attitude approximating the upright attitude of previously-delivered carton blanks 10 within the array supported on conveying surface 15 of the receiving machine hopper 14. A lower end of each guide 31 is then upwardly adjacent to the conveying surface 15 (see FIG. 21).

This equipment is designed to rearrange the previously-deposited array of carton blanks within machine hopper 14 in their intended upwardly inclined attitude as each new bundle 11 is delivered onto the receiving conveying surface 15 of the machine hopper 14. This is shown to the left in FIG. 21. It is common for one or more of the carton blanks to loosely fall from this position, as again illustrated in FIG. 21.

To properly reform the array of carton blanks in the machine hopper 14, the present equipment is designed to crowd against the carton blanks on conveying surface 15, thereby forcing all of the blanks to their intended inclined attitudes.

Figure 21:
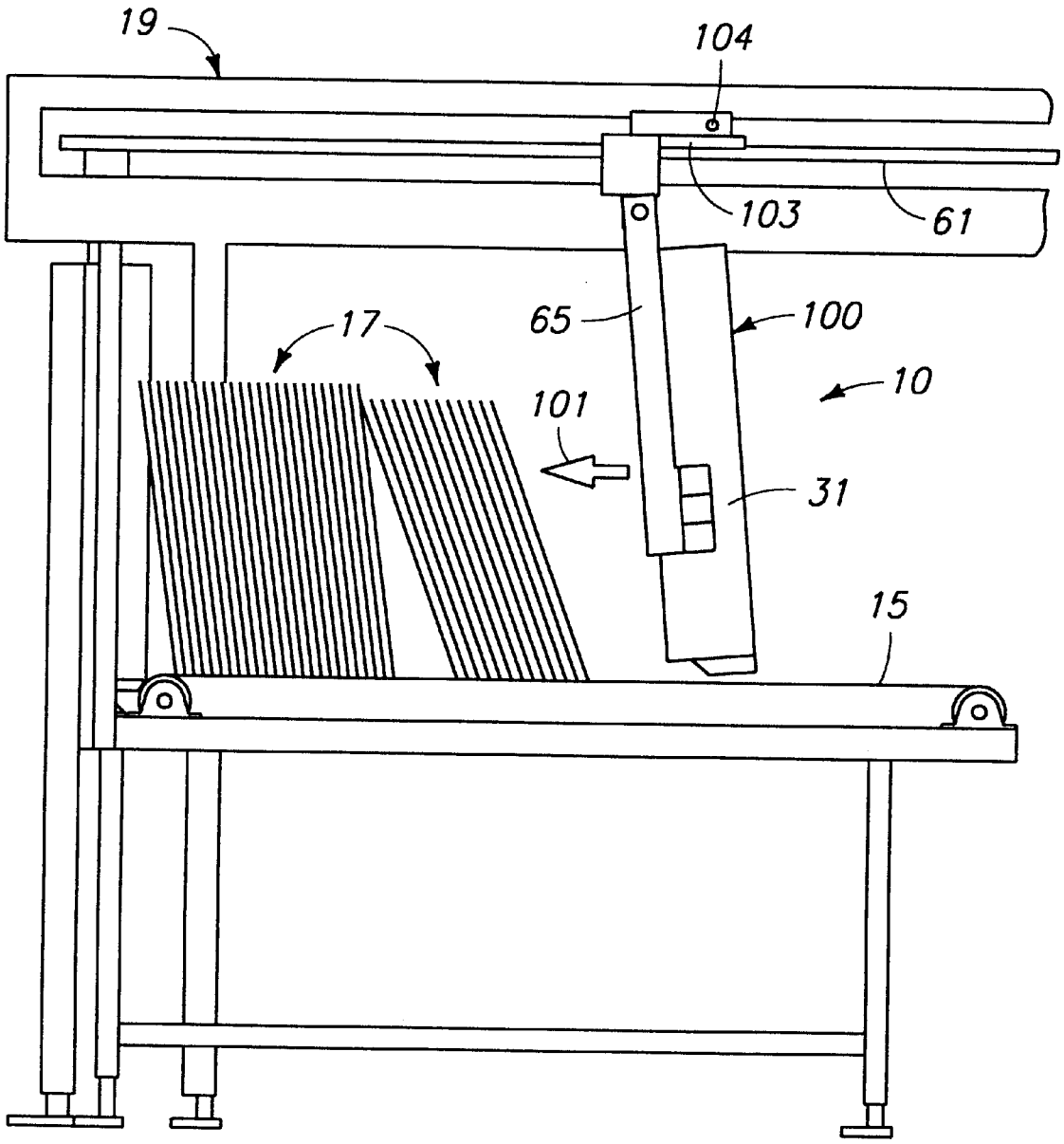
FIG. 21 is a diagrammatic side elevation view illustrating the manner by which carton blanks are directed toward an awaiting array of products on a horizontal hopper.

To accomplish this, the bundle transporter 30 is shifted longitudinally in the direction shown by arrow 101 in FIG. 21. It is to be noted that the angle of inclination of the bundle transporter 30 while in its angularly inclined position 100 is slightly in excess of the intended angle of inclination of the carton blanks in the machine hopper 14. As an example, if the intended angle of inclination of carton blanks in the machine hopper 14 is 80 degrees, the facing surfaces of guides 31 in the bundle transporter 30 would be at an initial inclination greater than this, such as 85 degrees.

Figure 22:
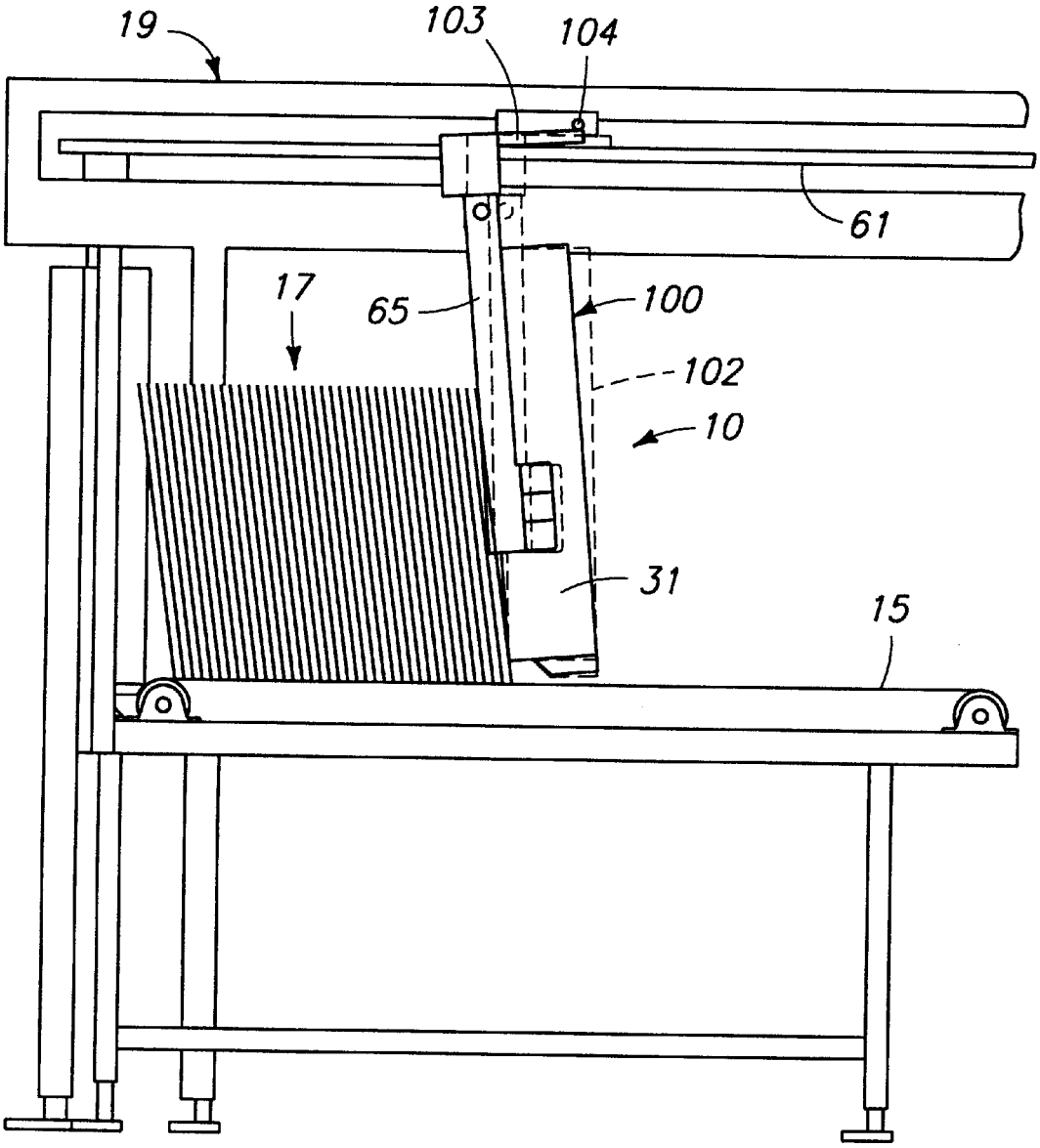
FIG. 22 is similar to FIG. 21, but illustrates crowding of the existing array and termination of movement of the bundle transporter 30.

As the bundle transporter 30 moves in the direction of arrow 101, the previously-delivered carton blanks will be engaged first at the bottom corner of the guides 31. Continued longitudinal movement will push the bottom edges of the carton blanks in the array into abutment with one another and bring all of the carton blanks along surface 15 into abutment as they are progressively engaged by the surfaces of guides 31. As seen in FIG. 22, the bundle transporter 30 and its guides 31 will eventually tilt slightly in opposition to the engagement of the array of blanks on the machine hopper 14. FIG. 22 illustrates the initial inclination of guides 31 in the dashed lines shown at 102 and the terminal inclination is shown in full lines for comparison.

As guides 31 and bundle transporter 30 pivot in opposition to the engaged array of carton blanks, the resulting pivotal movement about shaft 62 can be detected relative to frame 60. Referring to FIG. 22, the slight pivotal movement of an arm 103 on the bundle transporter 30 might be detected with respect to a proximity switch 104 on the frame 60. The detection of such movement is used as a signal to terminate longitudinal movement of the chain 64 that imparts movement to the bundle transporter 30. In this manner, longitudinal movement of bundle transporter 30 is ended when the array of carton blanks has been reformed in preparation for discharge of the bundle currently between the guides 31.

After longitudinal movement of bundle transporter 30 has been completed, the gates 32 are pivoted outwardly to drop the carton blanks onto conveying surface 15 and guides 31 are subsequently spread apart on bundle transporter 30 to free the carton blanks as an addition to the array of blanks in the machine hopper 14. The carton blanks are then clear of the bundle transporter 30, which can be pivoted upwardly to its horizontal orientation along the framework 19 as it is returned to the bundle transfer station 22.

The method for discharging sheet-like products, such as carton blanks, from a palletized configuration of bundles to an awaiting machine hopper is believed to be relatively clear from the above machine descriptions. However, it will be summarized in the following paragraphs.

First, the individual bundles 11 are removed from the pallet 13 by moving the bundle vertically, transversely and longitudinally, and while rotating it about a vertical axis. This is accomplished by operation of the vacuum cups 21, which lift each successive bundle and locates it at bundle transfer station 22 (see FIG. 8). At this point, each bundle 11 has one or more straps 16 encircling it. The straps 16 are aligned parallel to a reference (longitudinal) direction with respect to the supporting framework 19.

After each bundle 11 has been lifted from the pallet 13, it is transferred to the awaiting bundle transporter 30 at bundle transfer station 22. Guides 31 and gates 32 on the bundle transporter 30 are in their closed positions to receive and support individual bundles 11 while in the position shown to the right in FIG. 4.

Each bundle 11 is next moved longitudinally within the bundle transporter 30 to locate one transverse end of it relative to the bundle transporter. This is best understood from FIG. 7, which illustrates the extension of blocks 50 to crowd the individual carton blanks toward the complementary inside surfaces of gates 32 and thereby stagger the elevational positions of the carton blanks 10 to facilitate removal of straps 16.

After each bundle 11 has been received and positioned within the bundle transporter 30, the bundle transporter shifts the bundle 11 longitudinally to the left from the position shown in FIG. 9 to the position shown in FIG. 10, where bundle transporter 30 is at an operational station 70 longitudinally displaced from the bundle transfer station 22. The resulting indexing of the one outer end of each bundle 11 aligns exposed portions of each strap 16 with the transversely movable guide 73 on shuttle frame 75 (see FIG. 11).

The strap removal assembly 40 operates to first force guide 73 between the bundle 11 and strap 16, then to grip the strap 16 by extension of plunger 76 while the shuttle frame 75 is stationary, and finally to sever each strap 16 by operation of shears 77. The engaged strap is subsequently directed into the powered chopper 90 after the supporting carriage 44 for the shuttle frame 75 has been moved laterally to a position in line with the chopper 90 (see FIG. 13 and FIGS. 14, 15 and 19).

The sheet-like products 10 within the bundle transporter 30, such as carton blanks, can then be pivoted about an axis perpendicular to the referenced longitudinal direction to arrange the loose bundle 11 in an upright angular position. This assumes that the receiving machine hopper 14 is horizontal. If the receiving hopper is vertical, this pivoting movement is unnecessary, and the bundle transporter 30 can merely drop the products into the upper end of an awaiting vertical hopper. It might or might not be necessary to first shift the longitudinal position of bundle transporter 30 in conjunction with such a discharge step.

Referring back to the illustrated embodiment, after pivoting of the bundle transporter 30, the carton blanks or other sheet-like products within it are held at an attitude that is preferably slightly beyond or in excess of the upright angular position of the sheet-like products within an array of such products already in place on the awaiting horizontal machine hopper 14.

Delivery of the carton blanks is completed by longitudinally moving the bundle transporter 30 toward the array, thereby crowding the existing array of carton blanks and ultimately causing the bundle transporter 30 to pivot slightly backwards in response to the opposition to movement encountered by abutment with the previously-placed carton blanks on the conveying surface 15. The resulting angular movement imparted to the bundle transporter 30 is detected to terminate longitudinal movement of the bundle transporter 30 and initiate release of the carton blanks by opening of the gates 22 and guides 31 (see FIGS. 1, 21 and 22).

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A depalletizer for handling bundles of sheet-like products held in a stack encircled by at least one strap, comprising:

a bundle supply mechanism operably mounted to move and position a bundle to a bundle transfer station;

a bundle transporter having movable guides that open to receive the bundle from the bundle supply mechanism and close to support the bundle; the bundle transporter being movable to shift the location of the bundle to an operational station displaced from the bundle transfer station;

a bundle positioning mechanism movably mounted relative to the movable guides for indexing an end of the bundle after the bundle is supported by the movable guides.

2. A depalletizer according to claim 1 wherein the bundle positioning mechanism produces an offset in the stack to space a portion of the stack from the at least one strap.

3. A depalletizer according to claim 1 wherein the bundle positioning mechanism produces an offset in the stack to space a portion of the stack from the at least one strap to form a space into which a strap cutter can move to cut the at least one strap.

4. A depalletizer according to claim 1 wherein the bundle transporter further comprises a gate movably mounted at a location wherein the bundle positioning mechanism moves the bundle against the gate.

5. A depalletizer according to claim 1 wherein:

the bundle positioning mechanism produces an offset in the stack to space a portion of the stack from the at least one strap to form a space into which a strap cutter can move to cut the at least one strap;

the bundle transporter further comprises a gate movably mounted at a location wherein the bundle positioning mechanism moves the bundle against the gate.

6. A depalletizer according to claim 1 wherein:

the movable guides of the bundle positioning mechanism are along opposing sides of the bundle and the bundle positioning mechanism acts upon the bundle in a longitudinal direction approximately parallel with contacting surfaces of the movable guides.

* * * * *